US009980569B1

(12) United States Patent
Chen

(10) Patent No.: US 9,980,569 B1
(45) Date of Patent: May 29, 2018

(54) AXIAL AND COMPRESSIVE LOAD SUPPORT ASSEMBLY FOR A SEAT

(71) Applicant: Xi Chen, Zhejiang (CN)

(72) Inventor: Xi Chen, Zhejiang (CN)

( * ) Notice: Subject to any disclaimer, the term of this patent is extended or adjusted under 35 U.S.C. 154(b) by 37 days.

(21) Appl. No.: 15/406,447

(22) Filed: Jan. 13, 2017

(51) Int. Cl.
*A47C 1/12* (2006.01)
*A47C 7/00* (2006.01)
*A47C 5/00* (2006.01)

(52) U.S. Cl.
CPC ..... *A47C 7/002* (2013.01); *A47C 5/00* (2013.01)

(58) Field of Classification Search
CPC ..... A47C 7/002; A47C 7/004; A47C 5/00; A47C 5/04; A47C 5/10
USPC ... 297/449.1, 188.01, 188.02, 440.1, 440.22; 248/188, 163.1
See application file for complete search history.

(56) References Cited

U.S. PATENT DOCUMENTS 2,709,560 A * 5/1955 Resk ..... F16M 11/08 248/169
2,794,612 A * 6/1957 Clifton ..... F16M 11/28 108/1
3,203,657 A * 8/1965 Thompson ..... A47C 3/24 248/171
5,439,269 A * 8/1995 Cheng ..... A47C 4/02 108/150
5,505,524 A * 4/1996 Drumwright ..... A47C 1/04 248/169
2003/0094551 A1* 5/2003 Corrales ..... A47C 7/004 248/163.1
2004/0011930 A1* 1/2004 Tuohy, III ..... A47G 23/0241 248/146
2004/0041064 A1* 3/2004 Cheng ..... A47B 13/003 248/188
2009/0094889 A1* 4/2009 Felling ..... A01K 63/006 47/39
2011/0187164 A1* 8/2011 Corcorran ..... A47B 39/00 297/170
2011/0316313 A1* 12/2011 Gasser ..... A47B 13/02 297/188.01
2017/0343151 A1* 11/2017 Kjellnnan ..... F16M 11/242

* cited by examiner

*Primary Examiner* — Mark R Wendell
(74) *Attorney, Agent, or Firm* — Tommy SF Wang; Wang IP Law Group, P.C.

(57) ABSTRACT

An axial and compressive load support assembly for supporting an axial load and longitudinal compression provides axial load and compressive support for a seat and a load. The assembly provides support through a vertical polyhedron member with radially extending L-shaped legs that from an obtuse angle. The polyhedron member bears an axial load, such as the seat and a load. A plurality of struts extend between the legs and the polyhedron member at an angle. The struts resist longitudinal compression by providing outwards-facing support in a lengthwise direction. A crossbar extends between the strut and the legs. The crossbar is defined by apertures configured to align with the fastening holes in the polyhedron member and enable passage of at least one fastener for detachably fastening the connected legs, struts, and crossbars to the polyhedron member. A wooden extension can be integrated into the second rod of the legs.

20 Claims, 6 Drawing Sheets

AXIAL AND COMPRESSIVE LOAD SUPPORT ASSEMBLY FOR A SEAT

FIELD OF THE INVENTION

The present invention relates generally to an axial and compressive load support assembly for supporting an axial load and longitudinal compression of a seat, and a load resting on the seat. The assembly is employed to provide support for a load and a user to sit down. More so, a leg support assembly relates to the field of portable seating units for controlling the support and stability when the leg support assembly is placed beneath a seat and upon a ground surface; whereby support of the seat is achieved through a plurality of L-shaped legs defined by an obtuse angle that join with a polyhedron member, and a plurality of struts extending between the legs and the polyhedron member configured to resist longitudinal compression; whereby the polyhedron member provides axial support and the struts resists longitudinal compression by providing outwards-facing support in a lengthwise direction for supporting the seat; whereby a steel version of the leg support assembly is integral; and whereby a wooden version of the assembly is assembled with fasteners.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

It is known in the art that a seat, or chair, is generally a place to sit to rest and take a load off the feet. The seat is often, a piece of furniture with a raised surface, commonly used to seat a single person.

Seats are supported most often by four legs and have a back. Seats are made of a wide variety of materials, ranging from wood to metal to synthetic material, plastic, and may also be padded or upholstered in various colors and fabrics. Seats are used in a number of rooms in homes e.g., in living rooms, dining rooms and dens, in schools and offices with desks, and in various other workplaces.

Often, a seat is supported by a fluid spring or other height adjustment device used in a support column to enable height adjustment of a seat, table or other surface. A metal standpipe is inserted into a seat base to provide a support column for the fluid spring, or the fluid spring itself functions as the support column. Often, the seat column is subjected to large amounts of stress from both the axial load of the person sitting on the seat, and longitudinal compressive loads from movement and lateral swaying by the occupant of the seat.

It is known that an axial load is a force administered along the lines of an axis. Axial loading occurs when an object is loaded so that the force is normal to the axis that is fixed. It is also known that a compression force, such as the longitudinal compression applied to an object, is the application of power, pressure, or exertion against the object that causes it to become squeezed, squashed, or compacted. Generally, both the material composition and the structure of the object provide the capacity to withstand such compressive loads tending to reduce the size of the object.

Other proposals have involved supportive structures for seats and chairs. The problem with these is that they do not provide both axial load and compressive force support. Also, the ergonomic design is not aesthetic or ornamental. Even though the above cited seat support devices meets some of the needs of the market, an axial and compressive load support assembly for supporting an axial load and longitudinal compression from the weight of a seat, and a load resting on the seat is still desired.

SUMMARY

Illustrative embodiments of the disclosure are generally directed to an axial and compressive load support assembly for supporting an axial load and longitudinal compression from the weight of a seat, and a load resting on the seat. The leg support assembly provides both axial and longitudinal compressive support for a seat and a load resting on the seat. The assembly provides support of the seat through a plurality of L-shaped legs defined by an obtuse angle that join with a polyhedron member. The polyhedron member bears an axial load, such as the seat and a load.

A plurality of struts extend between the legs and the polyhedron member at an angle. The struts resist longitudinal compression by providing outwards-facing support in a lengthwise direction. A crossbar extends between the strut and the legs. The crossbar is defined by apertures configured to align with the fastening holes in the polyhedron member and enable passage of at least one fastener for detachably fastening the connected legs, struts, and crossbars to the polyhedron member. A wooden extension can be integrated into the second rod of the legs.

In one aspect, a leg support assembly for supporting a seat, comprises:

- a polyhedron member comprising a sidewall defined by a plurality of fastening holes, a top opening, and a bottom opening, the polyhedron member being configured to bear an axial load;
- a plurality of legs defined by a first rod and a second rod joined to form a generally L-shape, whereby an obtuse angle forms between the first rod and the second rod, the first rod having a first leg end configured to detachably attach to the sidewall of the polyhedron member, the second rod having a second leg end, the plurality of legs disposed to extend radially from the polyhedron member;
- a plurality of struts comprising a first strut end and a second strut end, the first strut end configured to join with the polyhedron member, the second strut end configured to join with the second rod of the plurality of legs, the plurality of struts configured to resist longitudinal compression by providing outwards-facing support in a lengthwise direction; and
- a plurality of crossbars configured to extend between the plurality of struts and the plurality of legs, the plurality of crossbars defined by a plurality of apertures configured to align with the plurality of fastening holes in the polyhedron member, the plurality of apertures further configured to enable passage of at least one fastener for detachably fastening the plurality of legs, the plurality of struts, and the plurality of crossbars to the polyhedron member.

In another aspect, the assembly further comprises a plurality of wooden extensions configured to detachably attach to the second rod in a generally parallel disposition through use of the fasteners.

In another aspect, the second rod is generally shorter when joined with the wooden extensions, than when used without wooden extensions.

In another aspect, the top opening of the polyhedron member is configured to receive a base portion of a seat.

In another aspect, the polyhedron member has a generally rectangular, elongated shape.

In another aspect, plurality of legs comprises four legs.

In another aspect, the plurality of struts comprises four struts.

In another aspect, the crossbars are disposed in a generally vertical orientation, perpendicular to the first rod of the legs.

In another aspect, the plurality of fasteners comprises a screw.

One objective of the present invention is to receive and provide support for a seat.

Another objective is to provide detachable L-shaped legs to the polyhedron member that are easily assembled and disassembled.

Another objective is to provide struts that resist longitudinal compression from a load on the seat.

Another objective is to provide a leg assembly that can be disassembled for stowage and moving.

Another objective is to provide a polyhedron member that bears axial weight from a load on the seat.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
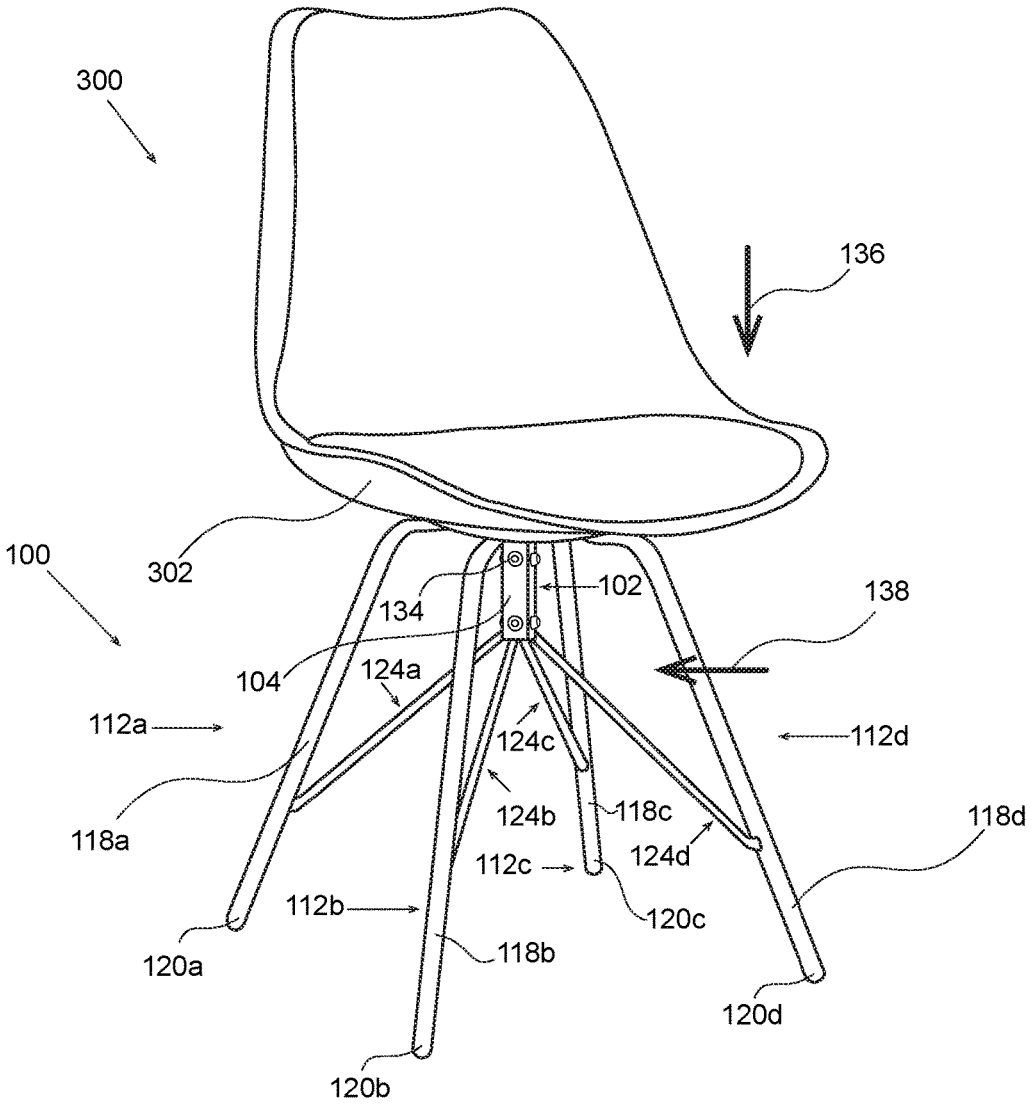
FIG. 1 illustrates a perspective view of an exemplary leg support assembly supporting a seat, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "first," "second," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

In one embodiment of the present invention presented in FIGS. 1-7, an axial and compressive load support assembly 100 for supporting an axial load and longitudinal compression from the weight of a seat 300, and a load that is resting on the seat 300. The axial and compressive load support assembly 100, hereafter "assembly 100" is configured to provide support for a seat 300 so that a user or load may sit down on a stable surface. In some embodiments, the assembly 100 helps support and stabilize the seat 300 when placed beneath the seat 300 and upon a ground surface.

As referenced in FIG. 1, the assembly 100 provides geometric support for the seat 300 through use of a plurality of L-shaped legs 112*a*-*d*. The legs 112*a*-*d* are defined by an obtuse angle 122 that enhances support. The legs 112*a*-*d* detachably attach to a central polyhedron member 102 in a radial arrangement. The polyhedron member 102 is configured to bear an axial load 136, such as the seat 300 and a load thereon. In one embodiment, four legs 112*a*, 112*b*, 112*c*, 112*d* extend radially from the sidewall, and specifically fastening holes 106*a*, 106*b*, in the polyhedron member 102.

Figure 2A:
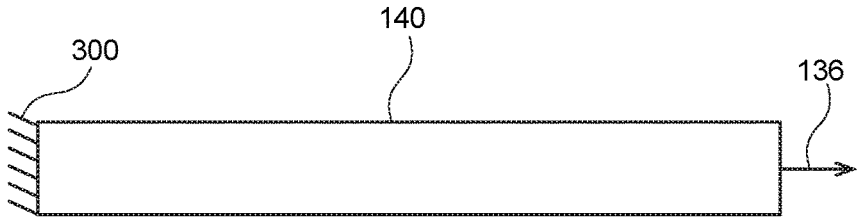
FIGS. 2A and 2B illustrate diagrams of an axial load normal to a fixed axis and an equal force applied to polyhedron member, in accordance with an embodiment of the present invention.

Turning now to FIG. 2A, those skilled in the art will recognize that an axial load 136 is a force administered along the lines of an axis 140. Axial loading occurs when an object is loaded so that the force is normal to the axis 140 that is fixed. This is seen in FIG. 1, as a polyhedron member 102, a seat 300, and possible a load, i.e. sitting person on the seat, presses down normally against the generally vertical support provided by the polyhedron member 102. The following formula indicates the stress that would be caused by axial loading on the polyhedron member 102, and even the legs 112*a*-*d* of the assembly 100:

$$\alpha = F/A$$

where $\alpha$=normal stress
F=force
A=area

Figure 2B:
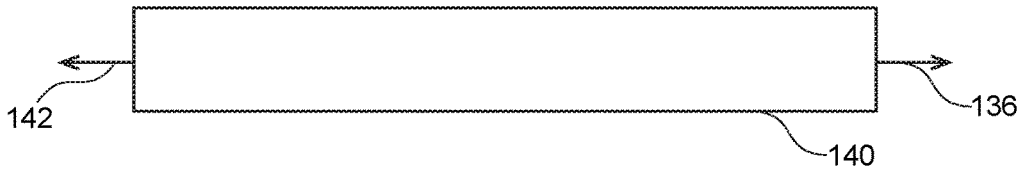

As FIG. 2B references, taking statics into consideration, the force 142 at the polyhedron member 102 is equal—in theory—to the axial load 136 that is applied to the seat 300.

Figure 3:
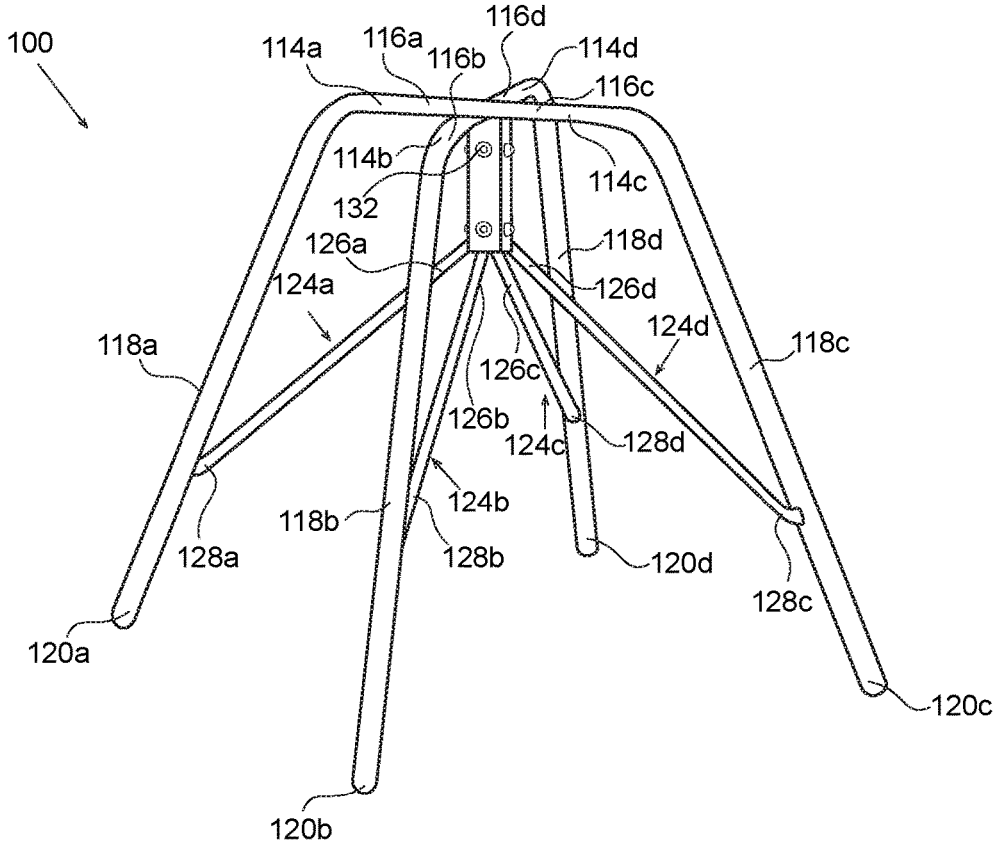
FIG. 3 illustrates a perspective view of a leg support assembly shown in FIG. 1, in accordance with an embodiment of the present invention.

Turning now to FIG. 3, the assembly 100 may also utilize a plurality of struts 124*a-d* extending between the legs 112*a-d* and the polyhedron member 102 at an angle. The struts 124*a-d* are configured to resist longitudinal compression 138 by providing outwards-facing support in a lengthwise direction. In this manner, separation between the legs 112*a-d* and the polyhedron member 102 is maintained while supporting the seat and any load on the seat. Thus, the polyhedron member 102 provides axial support, while the struts 124*a-d* provide support against longitudinal compression.

Those skilled in the art will recognize that a compression force, such as the longitudinal compression 138 applied to the struts 124*a-d*, is the application of power, pressure, or exertion against the struts 124*a-d* that causes it to become squeezed, squashed, or compacted. Thus, both the material composition and the sloped disposition of the struts 124*a-d* provide the capacity to withstand such compressive loads tending to reduce the longitudinal size of the assembly 100.

The assembly 100 may also include a plurality of crossbars 130*a-d* that are disposed to extend between the struts 124*a-d* and the legs 112*a-d*. The crossbars 130*a-d* may be defined by a plurality of apertures 132*a*, 132*b* configured to align with the fastening holes 106*a*, 106*b* in the polyhedron member 102 and enable passage of at least one fastener 134 for detachably fastening the connected legs 112*a-d*, struts 124*a-d*, and crossbars 130*a-d* to the polyhedron member 102.

In an alternative embodiment, a plurality of wooden extensions 202*a-d* may be integrated into the legs 112*a-d* to extend the height of the legs 112*a-d* and provide a unique wooden ornamental effect. Thus, the steel version of the support assembly 100 is integrally welded together; and the wooden version of the assembly 200 is assembled with the aforementioned fasteners 134.

Those skilled in the art will recognize that a chair is a type of seat that may be supported by the leg support assembly 100 described herein. The chair is generally a piece of furniture with a raised surface, commonly used to seat a single person or other load. Chairs are supported most often by four legs and have a back. Chairs are made of a wide variety of materials, ranging from wood to metal to synthetic material, plastic, and may also be padded. Chairs are used in a number of rooms in homes e.g., in living rooms, dining rooms and dens, in schools and offices with desks, and in various other workplaces.

As discussed above, the present invention provides an axial and compressive load assembly 100 that provides substantial support to a seat 300 (or chair), and forces/loads that may be applied from both the weight of the seat 300 and objects on the seat 300. As FIG. 3 references, the assembly 100 comprises a polyhedron member 102 comprising a sidewall 104. In one embodiment, the sidewall 104 is elongated and has four or more sides. Though other generally linear shapes and dimensions for the sidewall 104 may be used, as long as an axial load 136 can be supported.

In some embodiments, the sidewall 104 may be defined by a plurality of fastening holes 106*a*, 106*b*, a top opening 108, and a bottom opening 110. The fastening holes 106*a*, 106*b* may be disposed in a spaced-apart relationship along the length of the sidewall 104.

In some embodiments, the top opening 108 of the polyhedron member 102 is sized and dimensioned to receive a base portion 302 of a seat 300, which may include a pole or a seating mount that fits in the top opening 108. In one embodiment, the polyhedron member 102 has six faces, including the top and bottom openings 108, 110. Suitable materials for the polyhedron member 102 may include, without limitation, steel, aluminum, metal alloys, a rigid polymer, wood, and a rigid material that can withstand an axial load from the weight of a seat 300, and a load that rests on the seat 300.

At least one fastener 134, such as a screw or bolt may pass through openings in the top opening 108 and the sidewall 104*s* of the polyhedron member 102 to enable detachable attachment between the assembly 100 and a base portion 302 of the seat 300. In one embodiment, the polyhedron member 102 has a generally rectangular, elongated shape. Though other shapes and dimensions may be used.

Figure 4:
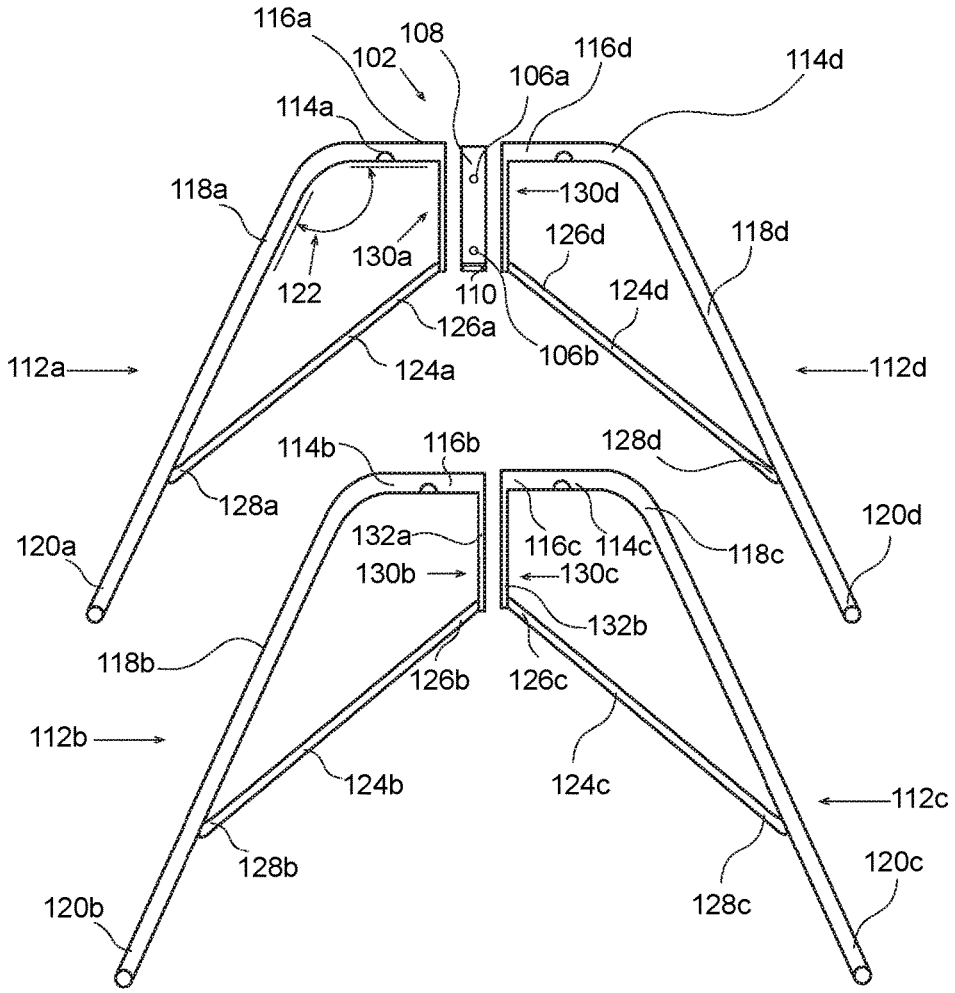
FIG. 4 illustrates a top view of a leg support assembly shown in FIG. 1 disassembled, in accordance with an embodiment of the present invention.

Turning now to FIG. 4, the assembly 100 may further comprise a plurality of legs 112*a-d* defined by a first rod 114*a-d* and a second rod 118*a-d*. The rods 114*a-d*, 118*a-d* may be joined to form a generally L-shape. In one embodiment, an obtuse angle 122 forms between the first rod 114*a-d* and the second rod 118*a-d*. The obtuse angle 122 may be slightly larger than 90°. Though any obtuse angle 122 greater than 90° and less than 180° may be used.

In one embodiment, the first rod 114*a-d* includes a first leg end 116*a-d* configured to detachably attach to the sidewall 104 of the polyhedron member 102 through use of fastening holes 106*a*, 106*b* and fasteners 134. The second rod 118*a-d* has a second leg end 120*a-d* configured to enable engagement with a surface, such as resting on the ground. The second leg end 120*a-d* may include a flat surface or, in an alternative embodiment, wheels.

In yet another embodiment, the first leg end 116-*d* of each leg 112*a-d* is secured in the opening by way of a snap effect and wherein each leg 112*a-d* is secured to its respective fastening hole in the sidewall 104 of the polyhedron member 102 by a projecting, rounded guide member 102 positioned at one end of the leg 112*a-d*. The guide member 102 may be adapted to engage a recess in the underside of the projecting portion of the legs 112*a-d*.

Looking back at the illustration in FIG. 3, the legs 112*a-d* extend radially and in an evenly spaced-apart relationship from the polyhedron member 102. In one embodiment, four equal legs 112*a*, 112*b*, 112*c*, 112*d* may extend in this arrangement. Suitable materials for the legs 112*a-d* may include, without limitation, steel, aluminum, metal alloys, a rigid polymer, and wood.

The assembly 100 may further comprise a plurality of struts 124*a-d* comprising a first strut end 126*a-d* and a second strut end 128*a-d*. The struts 124*a-d* enhance structural integrity of the assembly 100, especially the longitudinal load-bearing capacity. In some embodiments, the first strut end 126*a* detachably attaches to the sidewall 104 of the polyhedron member 102.

In other embodiments, the second strut end 128*a* detachably attaches to the second rod 118*a* of a leg 112*a*. The fasteners 134 may be used to form secure attachments and enable fast, efficient disassembly 100 between the struts 124*a-d* and polyhedron member 102. In one embodiment, four struts 124*a*, 124*b*, 124*c*, 124*d* may join with four corresponding legs 112*a*, 112*b*, 112*c*, 112*d*.

Those skilled in the art will recognize that the rigidity and angular disposition of the struts 124*a-d* in relation to the second rod 118*a-d* of the legs 112*a-d* enables the struts 124*a-d* to resist longitudinal compression 138 by providing outwards-facing support in a lengthwise direction. This resistance to longitudinal compression combined with axial bearing support provided by the polyhedron member 102 creates a synergy for substantial comfort and support for a seat.

The assembly 100 may further comprise a plurality of crossbars 130*a-d* configured to extend between the plurality of struts 124*a-d* and the plurality of legs 112*a-d*. In one embodiment, the crossbars 130*a-d* are disposed in a generally vertical orientation in relation to the first rod 114*a-d* of the legs 112*a-d*. Four crossbars 130*a*, 130*b*, 130*c*, 130*d* may join with four corresponding legs 112*a*, 112*b*, 112*c*, 112*d*, so as to provide equitable, radial support for both the axial and longitudinal directions.

In some embodiments, the crossbars 130*a-d* may be defined by a plurality of apertures 132*a*, 132*b* configured to align with corresponding fastening holes 106*a*, 106*b* in the polyhedron member 102. The apertures 132*a*, 132*b* also serve to enable passage of at least one fastener 134 for detachably fastening the connected legs 112*a-d*, struts 124*a-d*, and crossbar 130*a-d* to the polyhedron member 102. Suitable materials for the crossbars 130*a-d* may include, without limitation, steel, aluminum, metal alloys, a rigid polymer, and wood.

Figure 5:
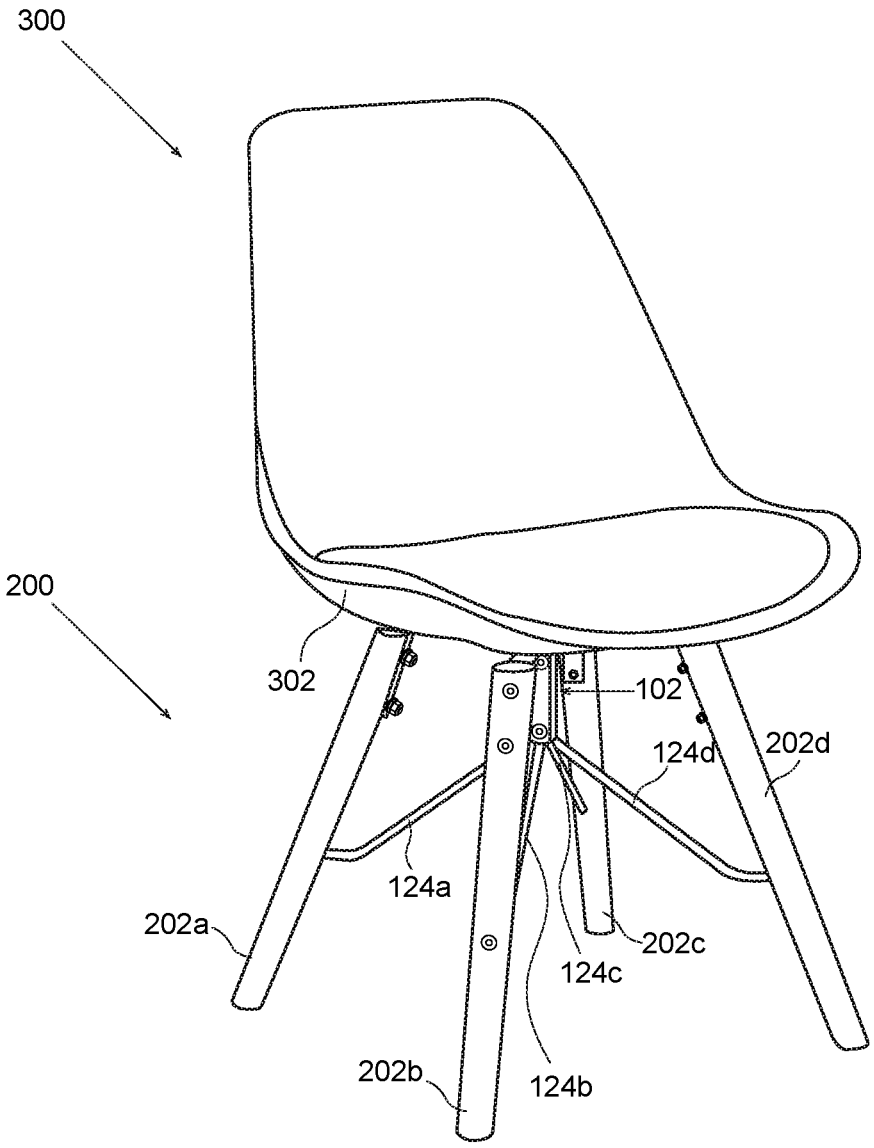
FIG. 5 illustrates a perspective view of an exemplary wooden leg support assembly supporting a seat, in accordance with an embodiment of the present invention.

FIG. 5 illustrates a perspective view of an exemplary wooden leg support assembly 200 supporting a seat 300. The wooden assembly 200 is substantially the same as the leg support assembly 100 discussed above, except that a plurality of wooden extensions 202*a-d* detachably attach to respective termini at the second rods 118*a-d* of the legs 112*a-d*.

Figure 7:
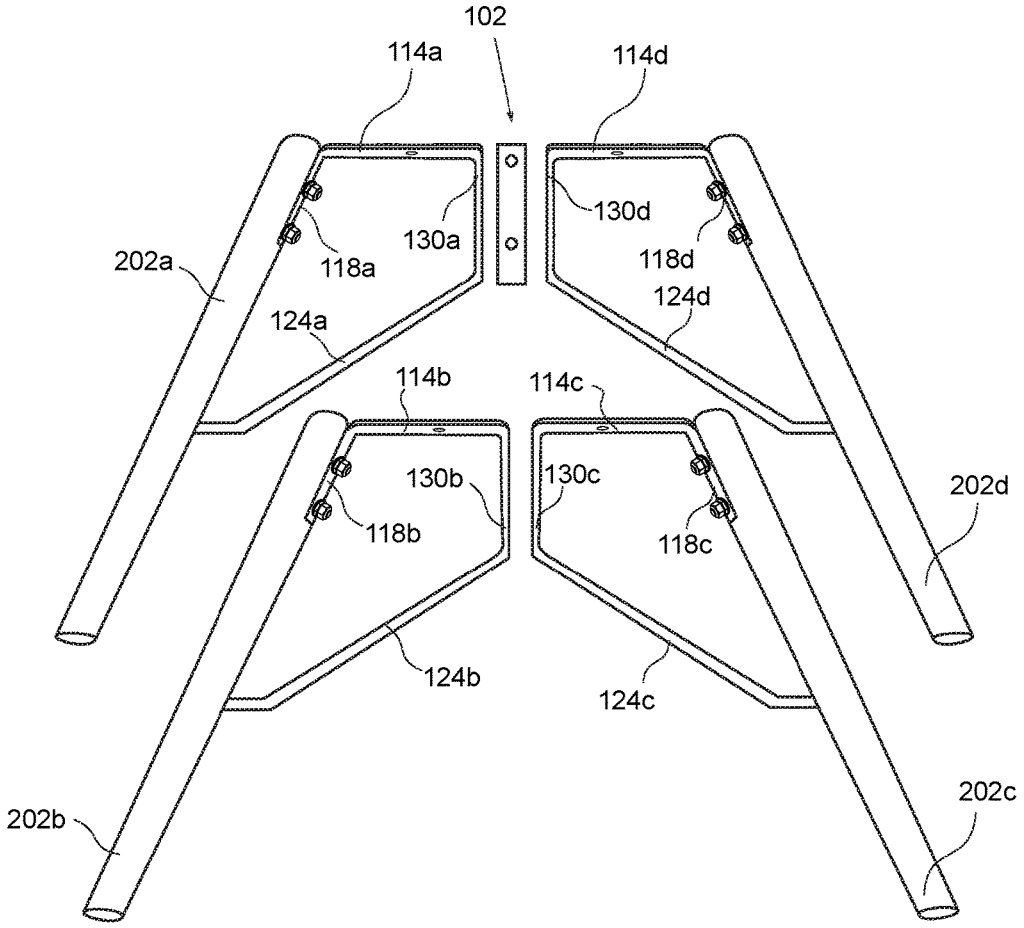
FIG. 7 illustrates a top view of a wooden leg support assembly shown in FIG. 5 disassembled, in accordance with an embodiment of the present invention.

In some embodiments, the wooden extensions 202*a-d* and the second rods 118*a-d* have a generally parallel disposition, in which fasteners 134 help to fasten the wooden extensions 202*a-d* to the ends of the second rods. In some embodiments, the second rod of the legs is generally shorter when the wooden extension 202*a-d* attaches thereto (FIGS. 4 and 7).

Figure 6:
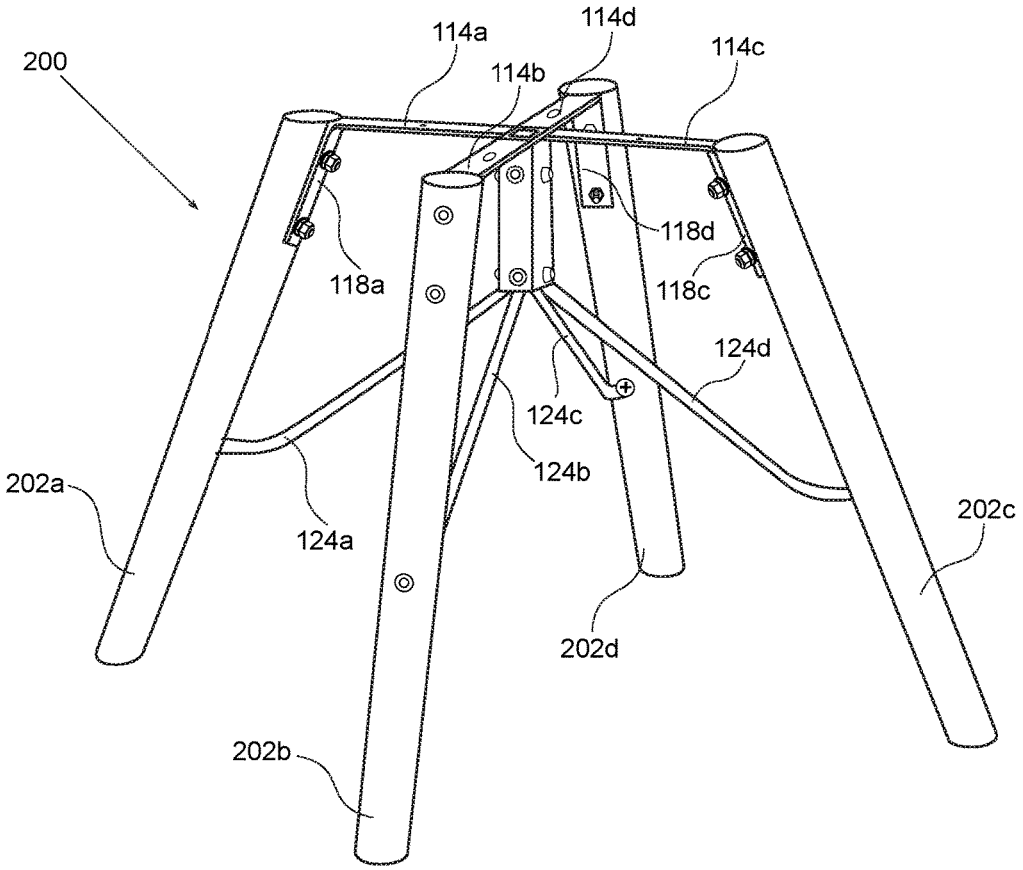
FIG. 6 illustrates a perspective view of a wooden leg support assembly shown in FIG. 5, in accordance with an embodiment of the present invention.

Turning now to FIG. 6, the wooden extensions 202*a-d* may be detachable from the second rods through use of fasteners. The wooden extensions 202*a-d* may have holes to enable passage of the fasteners for detachable fastening of the wooden extension to the legs. In some embodiments, four wooden extensions may be used. In addition to the visual effects of wood compared to metal, the wooden extensions may also increase the height of the assembly 200 since they are attached to the ends of the second rods 118*a-d* on the legs 112*a-d*. The wooden extensions 202*a-d* may also provides a decorative effect. Various shades of wood and wood stain may be used to enhance this effect.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A leg support assembly for supporting an axial and compressive load support assembly, the assembly comprising:

a polyhedron member comprising a sidewall defined by a plurality of fastening holes, a top opening, and a bottom opening, the polyhedron member being configured to bear an axial load;

a plurality of legs defined by a first rod and a second rod joined to form a generally L-shape, whereby an obtuse angle forms between the first rod and the second rod, the first rod having a first leg end configured to detachably attach to the sidewall of the polyhedron member, the second rod having a second leg end, the plurality of legs disposed to extend radially from the polyhedron member;

a plurality of struts comprising a first strut end and a second strut end, the first strut end configured to join with the polyhedron member, the second strut end configured to join with the second rod of the plurality of legs, the plurality of struts configured to resist longitudinal compression by providing outwards-facing support in a lengthwise direction; and a plurality of crossbars configured to extend between the plurality of struts and the plurality of legs, the plurality of crossbars defined by a plurality of apertures configured to align with the plurality of fastening holes in the polyhedron member.

2. The assembly of claim 1, wherein the polyhedron member has a generally rectangular, elongated shape.

3. The assembly of claim 1, wherein the top opening of the polyhedron member is configured to receive a seat.

4. The assembly of claim 1, wherein the plurality of legs comprises four legs.

5. The assembly of claim 1, wherein the plurality of struts comprises four struts.

6. The assembly of claim 1, wherein the plurality of crossbars is disposed in a generally vertical orientation.

7. The assembly of claim 1, further comprising a plurality of wooden extensions configured to join the second rod in a generally parallel disposition.

8. The assembly of claim 7, wherein the plurality of wooden extensions substantially encapsulates the second rod.

9. The assembly of claim 1, further comprising at least one fastener.

10. The assembly of claim 9, wherein the plurality of apertures are configured to enable passage of the at least one fastener for detachably fastening the plurality of legs, the plurality of struts, and the plurality of crossbars to the polyhedron member.

11. The assembly of claim 10, wherein the at least one fastener comprises a screw.

12. The assembly of claim 1, further comprising a seat configured to join with the top opening of the polyhedron member.

13. A leg support assembly for supporting an axial and compressive load support assembly, the assembly comprising:

a polyhedron member comprising a sidewall defined by a plurality of fastening holes, a top opening, and a bottom opening, the polyhedron member being configured to bear an axial load;

a plurality of legs defined by a first rod and a second rod joined to form a generally L-shape, whereby an obtuse angle forms between the first rod and the second rod, the first rod having a first leg end configured to detachably attach to the sidewall of the polyhedron member, the second rod having a second leg end, the plurality of legs disposed to extend radially from the polyhedron member;

a plurality of struts comprising a first strut end and a second strut end, the first strut end configured to join with the polyhedron member, the second strut end configured to join with the second rod of the plurality of legs, the plurality of struts configured to resist longitudinal compression by providing outwards-facing support in a lengthwise direction;

a plurality of crossbars configured to extend between the plurality of struts and the plurality of legs, the plurality of crossbars defined by a plurality of apertures configured to align with the plurality of fastening holes in the polyhedron member, the plurality of apertures further configured to enable passage of at least one fastener for detachably fastening the plurality of legs, the plurality of struts, and the plurality of crossbars to the polyhedron member; and a plurality of wooden extensions configured to join with the second rod in a generally parallel disposition.

14. The assembly of claim 13, wherein the plurality of wooden extensions substantially encapsulates the second rod.

15. The assembly of claim 13, wherein the top opening of the polyhedron member is configured to receive a seat.

16. The assembly of claim 13, wherein the polyhedron member has a generally rectangular, elongated shape.

17. The assembly of claim 13, wherein the plurality of legs comprises four legs.

18. The assembly of claim 13, wherein the plurality of crossbars is disposed in a generally vertical orientation.

19. The assembly of claim 13, further comprising a seat configured to join with the top opening of the polyhedron member.

20. An axial and compressive load support assembly for supporting an axial load and longitudinal compression on a seat, the assembly consisting of:

a polyhedron member comprising a sidewall defined by a plurality of fastening holes, a top opening, and a bottom opening, the polyhedron member being configured to bear an axial load;

four legs defined by a first rod and a second rod joined to form a generally L-shape, whereby an obtuse angle forms between the first rod and the second rod, the first rod having a first leg end configured to detachably attach to the sidewall of the polyhedron member, the second rod having a second leg end, the four legs disposed to extend radially from the polyhedron member;

four struts comprising a first strut end and a second strut end, the first strut end configured to join with the polyhedron member, the second strut end configured to join with the second rod of the four legs, the four struts configured to resist longitudinal compression by providing outwards-facing support in a lengthwise direction;

four crossbars configured to extend between the four struts and the four legs, the four crossbars defined by a plurality of apertures configured to align with the plurality of fastening holes in the polyhedron member, the plurality of apertures further configured to enable passage of at least one fastener for detachably fastening the four legs, the four struts, and the four crossbars to the polyhedron member;

four wooden extensions configured to join with the second rod of the four legs in a generally parallel disposition; and a seat configured to join with the top opening of the polyhedron member.

* * * * *